US007255766B2

(12) United States Patent
Kenmochi et al.

(10) Patent No.: US 7,255,766 B2
(45) **Date of Patent: *Aug. 14, 2007**

(54) DISPOSABLE WIPE-OUT SHEET AND PROCESS FOR MAKING THE SAME

(75) Inventors: Yasuhiko Kenmochi, Kagawa (JP); Yoshinori Tanaka, Kagawa (JP)

(73) Assignee: Uni-Charm Corporation, Ehime-ken (JP)

( * ) Notice: Subject to any disclaimer, the term of this patent is extended or adjusted under 35 U.S.C. 154(b) by 66 days.

This patent is subject to a terminal disclaimer.

(21) Appl. No.: 11/004,775

(22) Filed: Dec. 3, 2004

(65) Prior Publication Data

US 2005/0092421 A1 May 5, 2005

Related U.S. Application Data

(62) Division of application No. 09/958,708, filed as application No. PCT/JP00/02390 on Apr. 12, 2000, now Pat. No. 6,830,801.

(30) Foreign Application Priority Data

Apr. 13, 1999 (JP) ..... 11-105943

(51) Int. Cl.

| | |
|---|---|
| ***B29C 65/02*** | (2006.01) |
| ***B29C 65/74*** | (2006.01) |
| ***B32B 38/04*** | (2006.01) |
| ***B32B 3/02*** | (2006.01) |
| *B29C 65/18* | (2006.01) |
| *B32B 3/16* | (2006.01) |

(52) U.S. Cl. ..... 156/251; 428/137; 428/138; 428/155; 428/194; 428/195.1; 156/250

(58) Field of Classification Search ..... 428/131, 428/137, 138, 155, 194, 195.1
See application file for complete search history.

(56) References Cited

U.S. PATENT DOCUMENTS

| | | | | |
|---|---|---|---|---|
| 5,543,004 | A | 8/1996 | Tochacek et al. | |
| 6,241,835 | B1 * | 6/2001 | Abe et al. | 156/73.2 |
| 2002/0127369 | A1 * | 9/2002 | Ackerman et al. | 428/137 |

FOREIGN PATENT DOCUMENTS

| | | | |
|---|---|---|---|
| CN | 1158283 | | 12/1996 |
| EP | 0774229 | A2 | 5/1997 |
| EP | 0777997 | A2 | 6/1997 |
| JP | 59-44963 | | 3/1984 |
| JP | 288113 | | 10/1992 |
| JP | 135798 | | 5/1997 |
| JP | 149873 | | 6/1997 |

* cited by examiner

*Primary Examiner*—Chris Fiorilla
*Assistant Examiner*—Sonya Mazumdar
(74) *Attorney, Agent, or Firm*—Butzel Long

(57) ABSTRACT

A disposable wipe-out sheet that includes a plurality of long fibers bonded to a heat-sealable base sheet by sealing lines. The long fibers include groups continuously extending between each pair of the adjacent sealing lines to form bridge-like portions and groups severed in two sections between each pair of the adjacent sealing lines so as to fluff upward on the base sheet.

3 Claims, 7 Drawing Sheets

DISPOSABLE WIPE-OUT SHEET AND PROCESS FOR MAKING THE SAME

RELATED APPLICATIONS

The present application is a divisional application of U.S. patent application Ser. No. 09/958,708, filed Oct. 11, 2001 now U.S. Pat. No. 6,830,801, which claims priority under 35 U.S.C. §371 to PCT/JP00/002390, filed Apr. 12, 2000, which claim priority under 35 U.S.C. §365 to Japanese Patent Application No. 11-105943, filed Apr. 13, 1999.

TECHNICAL FIELD OF THE INVENTION

This invention relates to a disposable wipe-out sheet suitable for wiping dust and/or dirt from floor or wall surface.

RELATED ART

Japanese Patent Application Publication No. 1997-135798A describes a disposable wipe-out sheet comprising a heat-sealable base sheet and a plurality of heat-sealable filaments bonded to the base sheet and extending in one direction. In this wipe-out sheet of prior art, the filaments are heat-sealed with the base sheet by a plurality of sealing lines extending transversely of the filaments and arranged intermittently in the axial direction of the filaments. Between each pair of the adjacent sealing lines, a plurality of filaments describe arcs which are convex upward from the heat-sealable base sheet so that dust and/dirt are caught and held in spaces or gaps defined by the base sheet and the arc-shaped filaments.

Japanese Patent Application Publication No. 1997-149873A describes a disposable wipe-out base sheet comprising a heat-sealable base sheet and a brush-like layer provided on one surface of the heat-sealable base sheet. The brush-like layer is obtained by deregistering or opening a tow which is a bundle of heat-sealable filaments and then cutting them into an appropriate length. With such a wipe-out sheet having such brush-like layer, the filaments cut in appropriate length function like brush bristles enabling dust and/or dirt to be effectively wiped out. The filaments cut in appropriate length advantageously move into narrow spaces or gaps often present on a floor or wall surface and thereby catch dust and/or dirt retained in these spaces or gaps.

The wipe-out sheet described in the Japanese Patent Application Publication No. 1997-135798A is certainly advantageous in that dust and/or dirt can be caught between the heat-sealable base sheet and the filaments describing arcs above the base sheet and then reliably held against falling off from the wipe-out sheet. However, the filaments can not easily move into narrow spaces or gaps and catch dust and/dirt present therein.

The wipe-out sheet described in the Japanese Patent Application Disclosure No. 1997-149873 is certainly convenient in that the filaments can smoothly move into narrow spaces or gaps and catch dust and/or dirt present therein. However, there is no constructional feature adapted to reliable hold dust and/or dirt once caught. While it is desired to impregnate the filaments with any suitable surfactant to overcome this problem, this would inevitable increase a manufacturing cost of the wipe-out sheet.

As will be understood from the foregoing description, these wipe-out sheets of prior art have both advantages and disadvantages. It is an object of this invention to provide a disposable wipe-out sheet and a process for making the same.

DISCLOSURE OF THE INVENTION

According to one aspect of this invention, there is provided a disposable wipe-out sheet comprising a heat-sealable base sheet and a plurality of heat-sealable long fibers heat-sealed with said base sheet and extending in one direction.

In such a disposable wipe-out sheet, the long fibers are bonded to the base sheet by a plurality of sealing lines arranged intermittently to extend in a direction crossing the one direction; bridge-like portions each formed by a group of said long fibers extending between each pair of the adjacent sealing lines are arranged intermittently in the direction crossing the one direction; and another groups of the long fibers lying between each pair of the bridge-like portion adjacent to each other in the direction crossing the one direction and extending between the pair of the adjacent sealing lines have respective lengths thereof severed in two sections of which at least the respective one sections can fluff on the base sheet with proximal ends thereof defined by the associated one of the sealing lines.

This invention relating to the wipe-out sheet includes embodiments as follows:

The heat-sealable base sheet is formed from a nonwoven fabric of thermoplastic synthetic fiber or a file of thermoplastic synthetic resin.

The heat-sealable long fibers are made of crimped conjugated fibers.

The heat-sealable base sheet is formed in a vicinity of zones in which the groups of the long fibers have respective lengths thereof severed in two sections with slits arranged intermittently in the direction crossing the one direction and said heat sealable base sheet is molten and solidified along peripheral edges of these slits.

The thermoplastic synthetic fiber of the nonwoven fabric are molten and solidified along the peripheral edges of the slits and thereby bonded together.

According to another aspect of this invention, there is provided a process for making a disposable wipe-out sheet comprising a heat-sealable sheet and a plurality of heat-sealable long fibers heat-sealed base with the base sheet and extending in one direction.

In such a process, this invention comprises the steps of bonding the long-fibers to the base sheet by a plurality of sealing lines extending in a direction crossing the one direction and arranged intermittently in the one direction; and pressing a cutter against an assembly of the long fibers and the heat-sealable base sheet so that plural groups of the long fibers extending between each pair of adjacent the sealing lines have respective lengths thereof severed in two sections and at the same time the heat-sealable base sheet is formed with slits whereupon the heat-sealable base sheet is molten and solidified along peripheral edges of the slits.

According to one embodiment this invention comprises the steps of: bonding the long fibers to upper and lower surfaces of the heat-sealable base sheet; and pressing the cutter against the assembly of the long fibers and the heat-sealable base sheet so that a plurality of long fibers lying on both sides of the heat-sealable base sheet are severed at once whereupon the heat-sealable base sheet is molten and solidified along the peripheral edges of the slits.

DESCRIPTION OF THE PREFERRED EMBODIMENTS

Details of a disposable wipe-out sheet according to this invention will be more fully understood from the description given hereunder with reference to the accompanying drawings.

Figure 1:
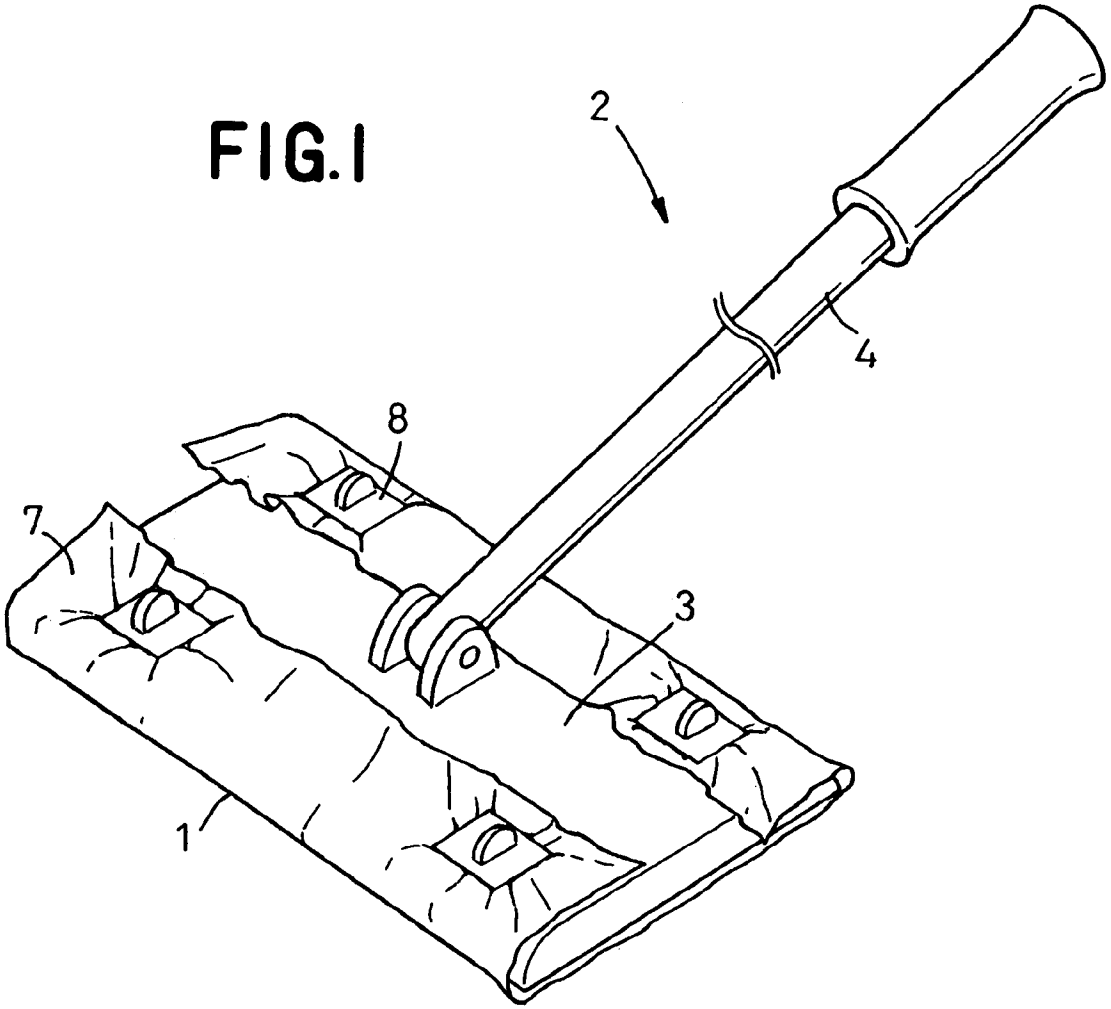
FIG. 1 is a perspective view showing a wipe-out sheet according to this invention as being actually used.

FIG. 1 is a perspective view showing a holder 2 with a disposable wipe-out sheet 1 attached thereto. The holder 2 comprises a base plate 3 and a stick 4. The sheet 1 placed against the lower surface of the base plate 3 has its opposite long side edge regions 7 folded back onto the upper surface of the base plate 3 and fastened to the upper surface by means of clips 8 mounted on the base plate 3. Dust and/or dirt on a floor or wall surface may be wiped out by the sheet 1 attached to the holder 2 with the stick 4 gripped in a user's hands.

Figure 2:
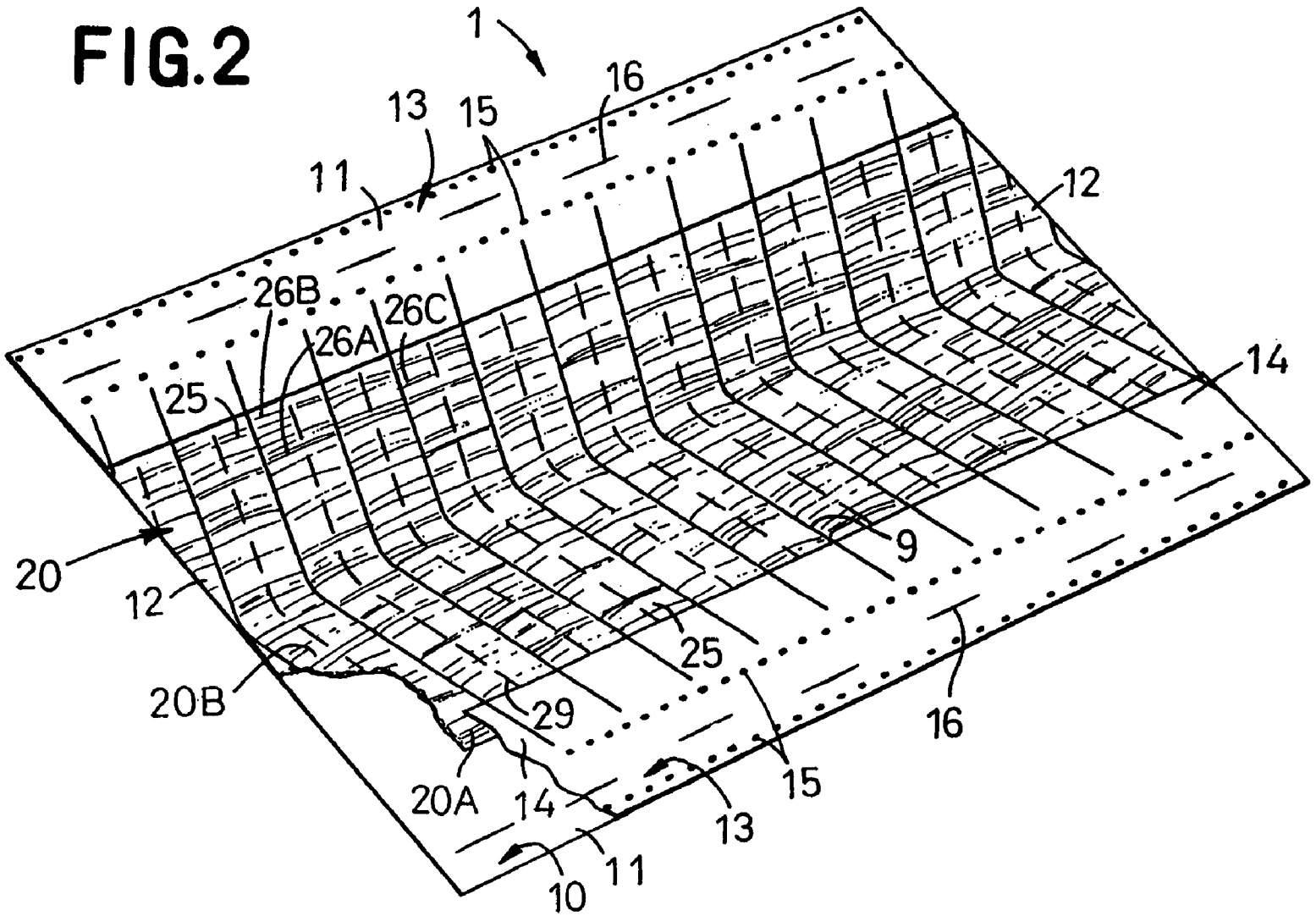
FIG. 2 is a perspective view showing the wipe-out sheet alone.

FIG. 2 is a partially cutaway perspective view showing the same sheet 1 as the sheet 1 shown by FIG. 1. The sheet 1 is herein illustrated as have been detached from the base plate 3 and developed with its wiper surface facing upward. The sheet 1 comprises a base sheet layer 10 made of a heat-sealable synthetic resin film or nonwoven fabric and a wiper layer 20 formed by a plurality of heat-sealable long fibers or filaments 25 bonded to the upper surface of the base sheet layer 10.

The base sheet layer 10 is of a rectangular shape defined by a pair of opposite long side edge regions 11 extending parallel to each other and a pair of opposite short side edges 12 extending also parallel to each other. Band-like reinforcing sheets 13 made of a synthetic resin film are heat-sealed with the opposite side edge regions 11 at a plurality of spots 15 in order to improve a tear strength of these side edge regions 11. Referring to FIG. 2, a pair of opposite side edge regions of the wiper layer 20 are covered with inner edge regions 14 of the respective reinforcing sheets 13. The side edge regions 11 of the base sheet layer 10 are formed with a plurality of slits 16 extending through these side edge regions 11 as well as the respective reinforcing sheets 13. These slits 16 facilitate the sheet 1 to be attached to the holder 2 by means of the clips 8.

The wiper layer 20 comprises a plurality of long fibers 25, i.e., continuous filaments extending substantially parallel to the side edge regions 11 of the base sheet layer 10. These long fibers 25 are heat-sealed with the base sheet layer 10 along a plurality of sealing lines 9 intermittently arranged to extend between the pair of opposite side edge regions 11 substantially parallel to each other in the direction of the opposite short side edge regions 12 of the base sheet layer 10. The respective long fibers 25 partially define relatively long bridge-like portions 26A connecting each pair of the adjacent sealing lines 9 and relatively short fluffy portions 26B formed by severing the remaining long fibers 25 between each pair of the adjacent sealing lines 9. Such wiper sheet layer 10 may be obtained by a process comprising the following steps. First, a tow which is a bundle of the long fibers 25 is deregistered or opened to have a predetermined width. These long fibers 25 are fed onto a web of heat-sealable base sheet which is continuously fed. Then the sealing lines 9 extending across the web of heat-sealable base sheet are formed intermittently with respect to the direction in which the web of heat-sealable base sheet is fed. Between each pair of the adjacent sealing lines 9, the long fibers 25 are severed intermittently across the direction in which the long fibers 25 are fed.

The sealing lines 9 are formed by heating the base sheet layer 10 together with an assembly of the long fibers 25 under a pressure exerted to them so that they are pressed against each other in the direction of thickness. The assembly of the long fibers 25 is bulky and the finished wipe-out sheet 1 is formed with a plurality of troughs 26C in the vicinity of the sealing lines 9 compressed at a high density as a result of the heating and pressing. Lengths of the long fibers 25 continuously extending between each pair of the adjacent sealing lines 9 form the convex bridge-like portions 26A describing arcs which are convex upwardly of the base sheet layer 10. The lengths of the long fibers 25 extending each pair of the adjacent sealing lines 9 are partially severed in two, respectively, to form the fluffy portions 26B.

The heat-sealable base sheet, i.e., the base sheet layer 10 having been assembled with the wiper layer 20 in the manner as has been described above may be provided along its opposite long side edge regions with the reinforcing sheets 13 bonded thereto and then cut into predetermined lengths to obtain the individual wipe-out sheets 1. To ensure that the wipe-out sheet 1 can be easily clipped to the base plate 3 (See FIG. 1) and the long fibers 25 can be economically used, the wiper layer 20 may be defined preferably 10-100 mm, more preferably 20-60 mm inside the outermost edges of the long side edge regions 11 of the base sheet layer 10. The opposite short side regions of the wiper layer 20 may be substantially aligned and sealed with the opposite short side edge regions 12 of the base sheet layer 10, respectively, to improve a tear strength of the base sheet layer 10 along its opposite short side edge regions 12.

Figure 3:
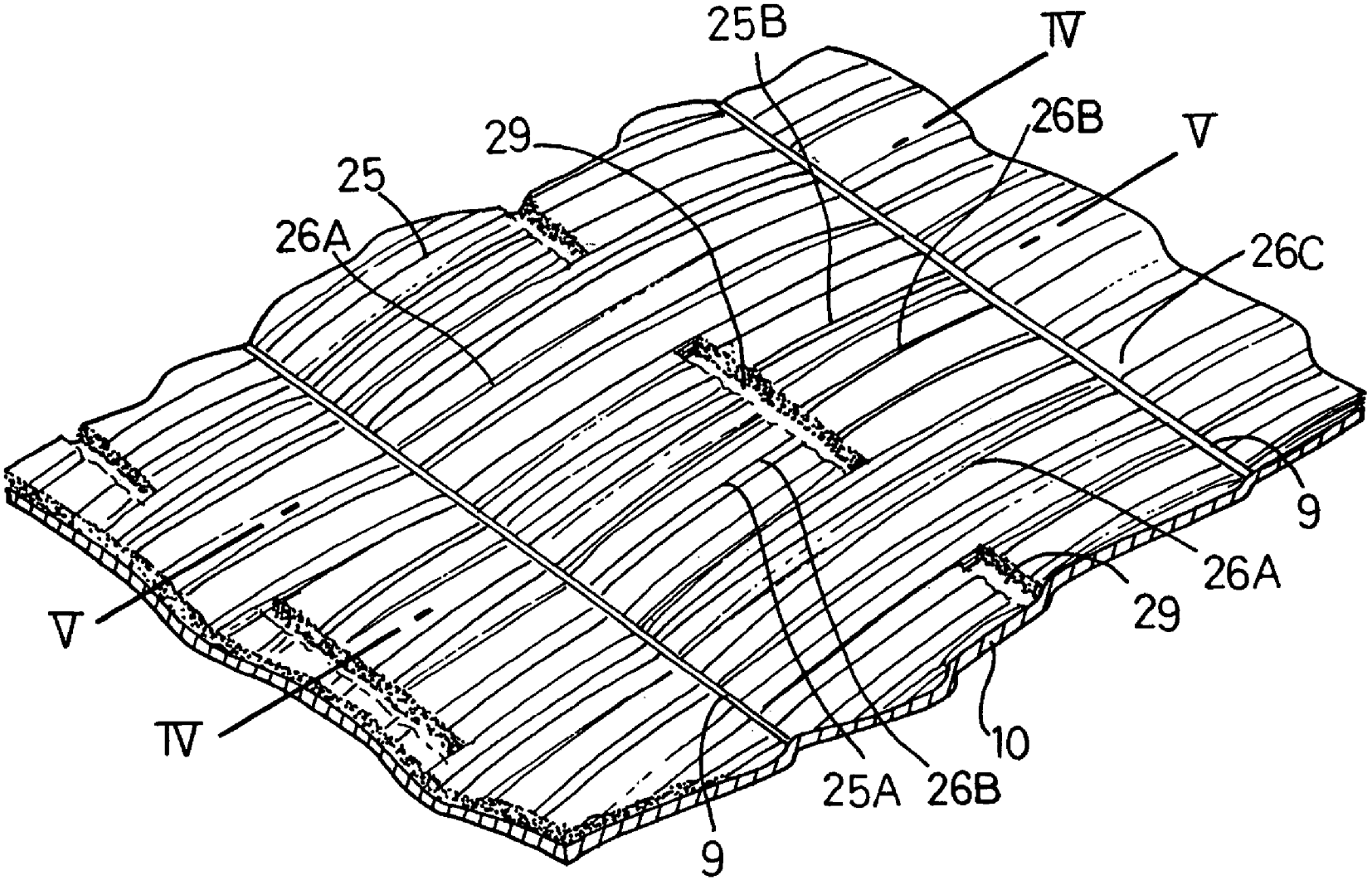
FIG. 3 is a perspective view showing an important part of the wipe-out sheet.

FIG. 3 is a scale-enlarged fragmentary perspective view showing an important part of the wipe-out sheet 1. The lengths of the long fibers 25 extending between each pair of the adjacent sealing lines 9, 9 are cut in two, respectively, along severing zones 29 extending intermittently between the opposite long side edge regions 11 of the base sheet layer 10 to form short fibers 25A, 25B. The long fibers 25 lying between each pair of the adjacent severing zones 29, 29 are not severed and form the bridge-like portions 26A fully extending between each pair of the adjacent sealing lines 9.

Figure 4:
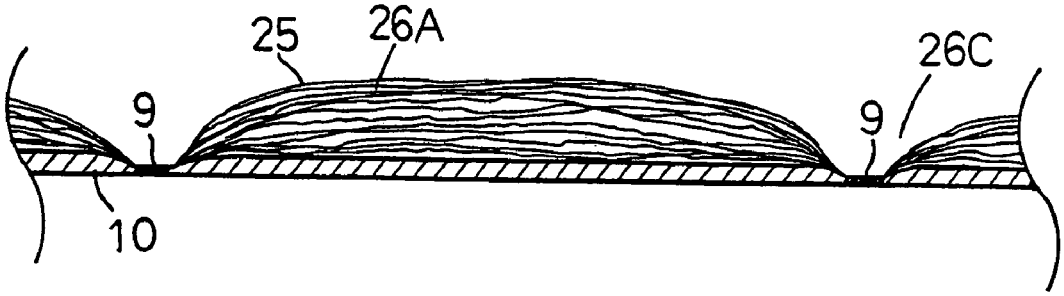
FIG. 4 is a sectional view taken along line IV-IV in FIG. 3.

FIG. 4 is a sectional view taken along line IV-IV in FIG. 3. Between each pair of the adjacent sealing lines 9, 9, a plurality of long fibers 25 form the bridge-like portions 26A describing arcs which are convex upwardly of the base sheet layer 10. Between each pair of the bridge-like portions 26A, 26A, the trough 26C is formed along the sealing line 9. During operation of wiping a floor or wall surface with the wipe-out sheet 1, the amount of dust and/or dirt once having been caught between the base sheet layer 10 and the assembly of the long fibers 25 can be reliably held on the wipe-out sheet 1. Tangled with the long fibers 25, the amount of dust and/or dirt is unlikely to fall off from the wipe-out sheet 1.

Figure 5:
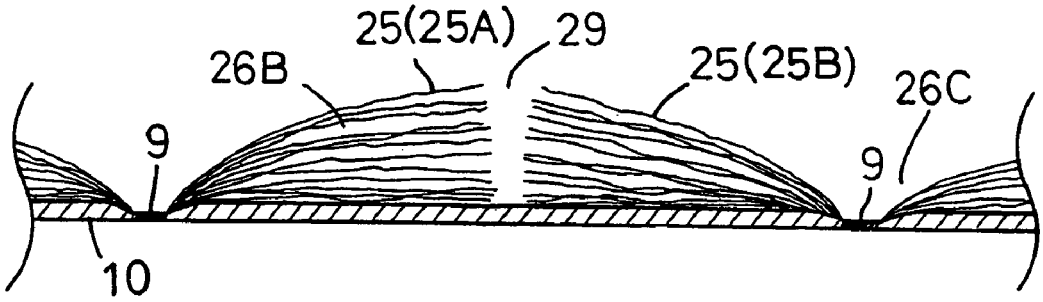
FIG. 5 is a sectional view taken along line V-V in FIG. 3.

FIG. 5 is a sectional view taken along line V-V in FIG. 3. The short fibers 25A, 25B have their respective one ends fixed to the base sheet layer 10 on the respective sealing lines 9 and their respective free ends adapted to move into various gaps possibly present on a floor or wall surface and thereby to catch dust and/or dirt present in these gaps as the floor or wall surface is wiped by the wipe-out sheet 1. A plurality of these short fibers 25A, 25B form together the fluffy portions 26B.

Figure 6:
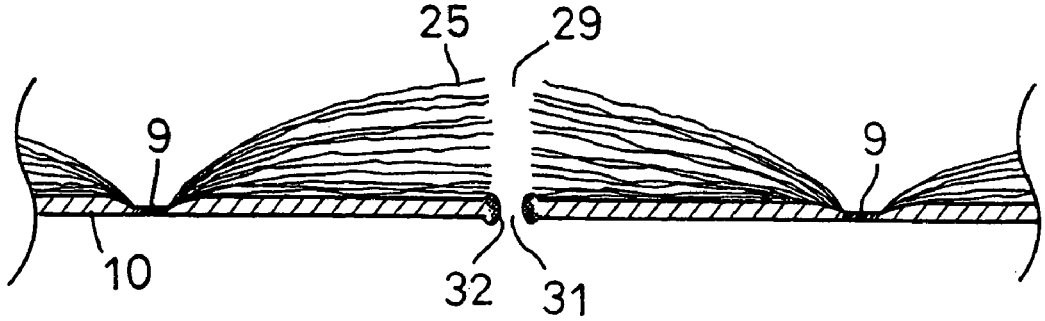
FIG. 6 is a view similar to FIG. 5 showing another embodiment of this invention.
Figure 7:
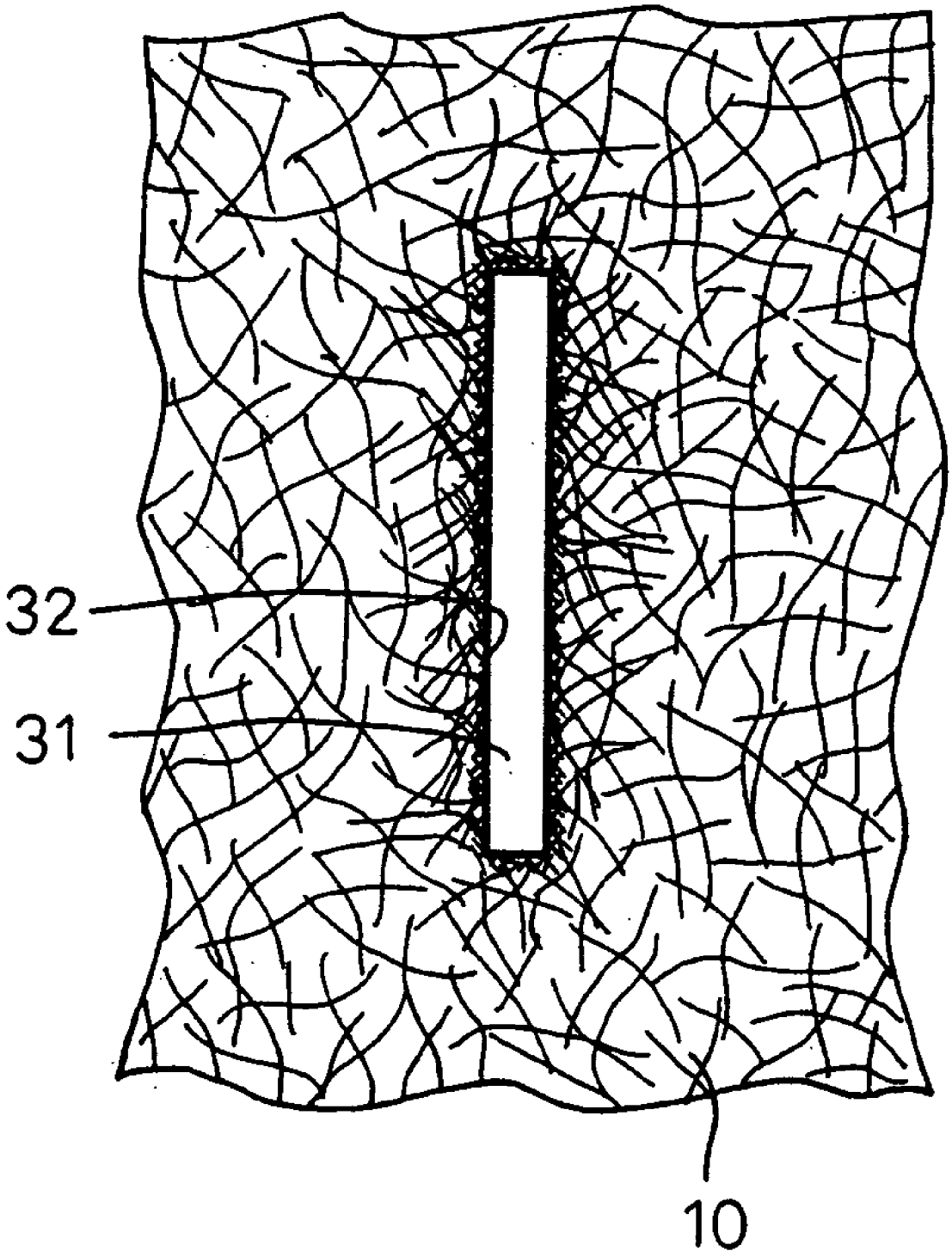
FIG. 7 is a rear view corresponding to FIG. 6.

FIG. 6 is a view similar to FIG. 5 showing another embodiment of this invention and FIG. 6 is a rear view corresponding to FIG. 5. The base sheet layer 10 in the wipe-out sheet 1 according to this embodiment is formed along the zones substantially corresponding to the severing zones 29 for the long fibers 25 with the slits 31. These slits 31 are formed by successively pressing blades 141 of a cutter 140 (See FIGS. 8 and 9) against the plurality of long fibers 25 downward from above as viewed in FIG. 6 to sever the long fibers 25 together with the base sheet layer 10. The blades 141 may be heated at an appropriate temperature if desired to facilitate the long fibers 25 to be severed. In the vicinity of peripheral edges 32 of these slits 31, the base sheet layer 10 is heated up to its melting point for an extremely short period as a result of friction with edges of the respective blades 141 and/or under a heat of the blades 141. Immediately after this short period, the fibers of the base sheet layer 10 are heat-sealed with the long fibers 25 in the vicinity of the respective slits 31 so far as the base sheet layer 10 is made of a nonwoven fabric as seen in FIG. 7. With such slits 31, the base sheet layer 10 well resists against a force exerted thereupon and tending to tear this. Also with the base sheet layer 10 made of a synthetic resin film monoaxially stretched in the direction parallel to the long fibers 25, the film may be once molten and solidified along the peripheral edges 32 of these slits 32 similarly to the case of FIG. 7 to eliminate a stretchability of the film along the peripheral edges 32 of these slits 31. Consequently, the film is unlikely to be torn. It may happen that ends of the long fibers 25 severed by the cutter are heat-sealed with the base sheet layer 10 and the adjacent long fibers 25 as a result of friction with the blades 141 and/or a heat of the blades 141. These long fibers 25 heat-sealed with the base sheet layer 10 and the adjacent long fibers 25 may be unfastened by brushing them with bristles.

Figure 8:
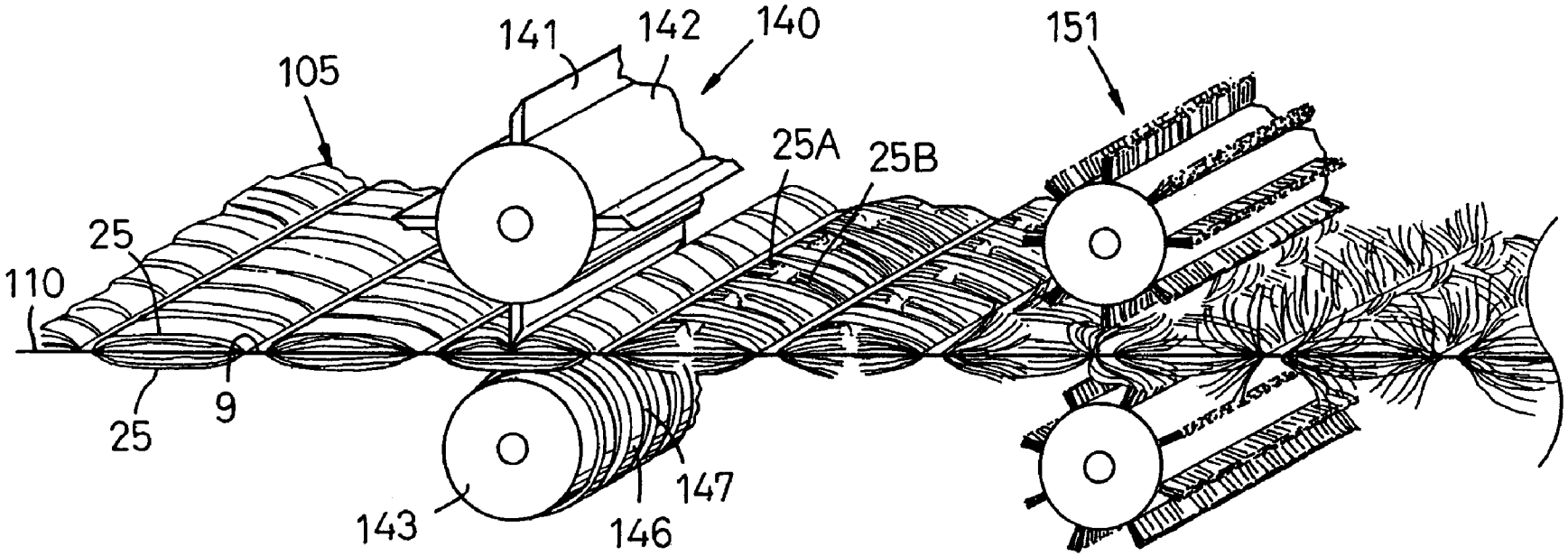
FIG. 8 is a fragmentary diagram of a process for making the wipe-out sheet.
Figure 9:
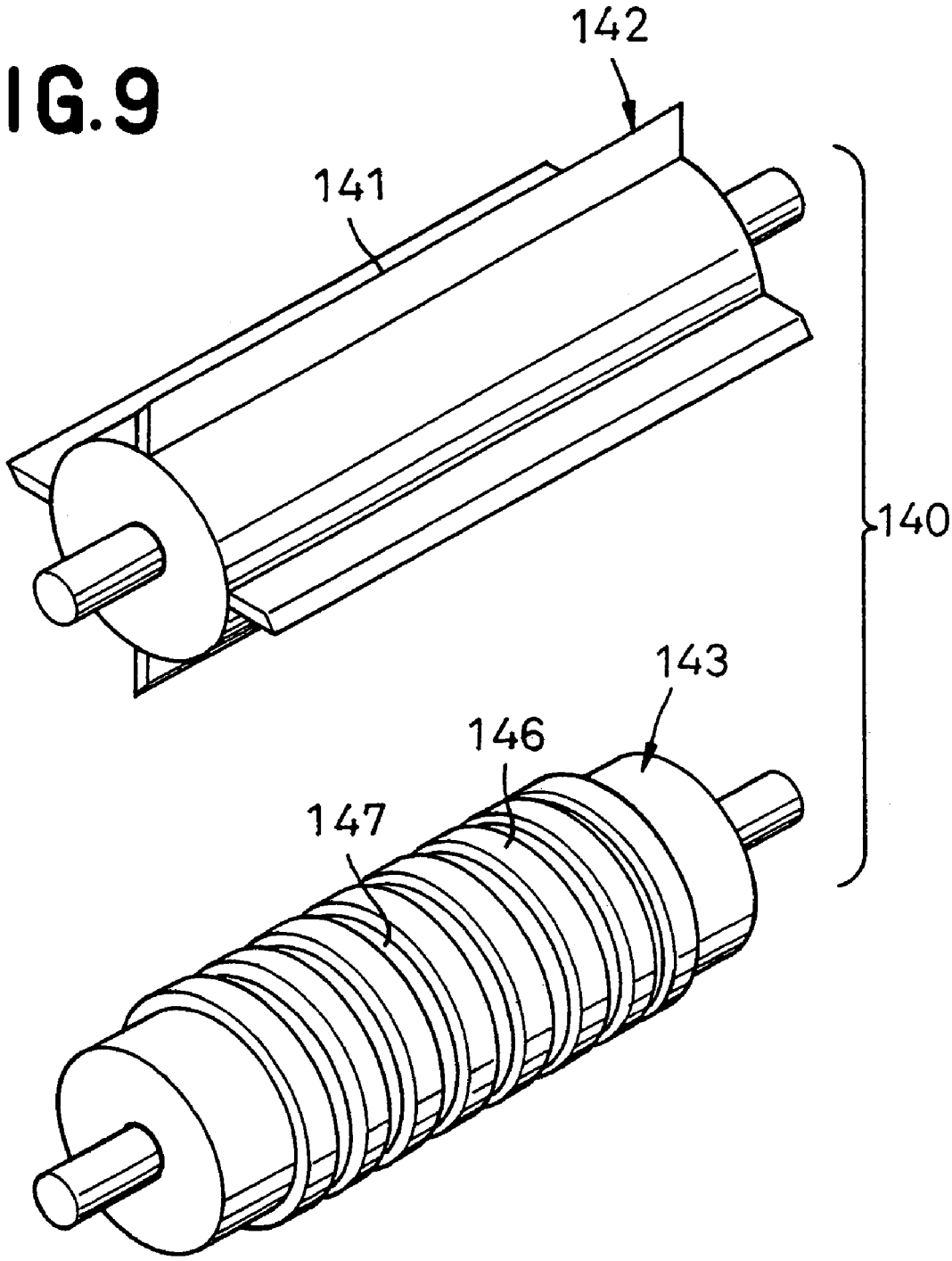
FIG. 9 is a perspective view showing a cutter.

FIG. 8 is a perspective view illustrating a step of severing the long fibers 25 in a process of making the wipe-out sheet 1 and FIG. 9 is a perspective view showing the cutter 140 used on this step. On this step, a web of composite sheet 105 is continuously fed from the left hand as viewed in FIG. 8. The web of composite sheet 105 comprises a continuous web of heat-sealable base sheet 110 as stock material of the base sheet layer 10 and the assemblies of long fibers 25 intermittently heat-sealed with upper and lower surfaces of the web of heat-sealable base sheet 110 along the respective sealing lines 9. In the composite sheet 105, the lengths of the long fibers 25 extending between each pair of the adjacent sealing lines 9, 9 are severed by the cutter 140 intermittently across the composite sheet 105. The cutter 140 comprises an upper roll 142 provided with blades 141 and a lower roll 143 against which the blades 141 are pressed against so that these upper and lower rolls 142, 143 press the composite sheet 105 therebetween and thereby simultaneously sever the long fibers 25 lying on the upper and lower surfaces of the heat-sealable base sheet 110. In this manner, the severing zones 29 (See FIGS. 2 and 3) and the slits 31 (See FIGS. 6 and 7) of the heat-sealable base sheet 110 are formed.

The upper roll 142 of the cutter 140 axially extends and includes a plurality of the blades 141 arranged at regular intervals circumferentially the roll 142 and these blades 141 may be heated at an appropriate temperature, if desired. The lower roll 143 includes a plurality of circumferential crests 146 and troughs 147 arranged alternately in its axial direction. The respective blades 141 of the upper roll 142 are pressed against the corresponding crests 146 of the lower roll 143 to cut off a group of the long fibers 25 by a width of each crest 146, thereby to form the short fibers 25A, 25B of the wipe-out sheet 1 and at the same time to form the heat-sealable base sheet 110 with the slits 31. The blades 141 do not act upon the long fibers 25 along the respective troughs 147 of the lower roll 143 to leave the lengths of the long fibers unchanged. In the course of cutting the composite sheet 105 by the blades 141, a frictional heat generated during operation of cutting and, in addition, a heat of the blades 141, if they are heated, melt and then solidify the heat-sealed base sheet 110 along the peripheral edges of the respective slits 31. In this manner, the state as illustrated by FIGS. 6 and 7 is obtained. Free ends of the short fibers 25A, 25B formed by severing the long fibers 25 may be also heat-sealed one with another or with the heat-sealable base sheet 110. To solve such problem, these free ends of the short fibers 25A, 25B heat-sealed one with another or with the heat-sealable base sheet 110 are unfastened one from another of from the heat-sealed base sheet 110 by subjecting the composite sheet 105 to the action of the rotary brush 151 after the composite sheet 105 has left the cutter 140 and thereby the fluffy portions 26B of the wipe-out sheet 1 are formed. Then the composite sheet 105 may be cut into predetermined lengths to obtain the individual wipe-out sheets 1.

The process as has been described above enables the wipe-out sheet 1 having the wiper layers 20 on both surfaces of the base sheet layer 10 to be easily obtained. The wipe-out sheet 1 obtained according to this process is unlikely to be easily torn although the base sheet layer 10 is formed with the slits 31.

In this wipe-out sheet 1, the base sheet layer 10 may be made of stock materials such as a nonwoven fabric of thermoplastic synthetic fiber having a basis weight of 10-200 g/m$^2$ or a thermoplastic synthetic resin film having a thickness of 0.01-0.1 mm.

Preferably, crimped fibers, more preferably crimped conjugated fibers may be used as the long fibers 25 to obtain the wiper layer 20 sufficiently bulky to easily catch and hold dust and/or dirt. Its function to catch dust and/dirt is further improved by impregnating the long fibers 25 with suitable surfactant. These long fibers 25 can be obtained by deregistering or opening a tow comprising 10,000-50,000 single filaments each having a fineness of 1-15 d.

Preferably, the sealing line 9 has a width of 0.5-5 mm and is spaced from the adjacent sealing line 9 by 10-100 μm. The severing zone 29 bisecting the long fibers 25 between each pair of the adjacent sealing lines 9 preferably has a length of 1-10 mm and preferably is spaced from the adjacent severing zone 29 by 1-20 mm.

The wipe-out sheet 1 illustrated in FIG. 8 includes, in addition to the wiper layer 20 extending on the upper surface of the base sheet layer 10, the similar wiper layer 20 extending on the lower surface of the base sheet layer 10 so that both surfaces of the sheet 1 may be used for wipe-out.

The disposable wipe-out sheet according to this invention functions not only to catch dust and/or dirt present in narrow spaces or gaps but also to hold such dust and/dirt once having been caught by the wipe-out sheet against falling off therefrom. This advantageous function enables floor or wall surfaces to be rapidly and reliably cleaned up. This invention further enables the base sheet layer to have a tear strength effectively improved by forming the base sheet layer with the slits and melting/solidifying the synthetic resin constituting the base sheet layer along the peripheral edges of the respective slits.

The invention claimed is:

1. A process for making a disposable wipe-out sheet comprising a heat-sealable base sheet and a plurality of heat-sealable fibers heat-sealed with said base sheet and extending in one direction, said process comprising the steps of:

providing a heat-sealable base sheet and a plurality of heat-sealable fibers which extend in a first direction;

bonding said fibers to said base sheet by a plurality of sealing lines extending in a second direction which crosses said first direction, said plurality of sealing lines being arranged intermittently in said first direction so as to form an assembly of said fibers and said heat-sealable base sheet; and pressing a cutter against said assembly of said fibers and said heat-sealable base sheet so that a plurality of first groups of said fibers extending between adjacent pairs of said sealing lines have respective lengths thereof that are severed into two sections and at substantially the same time said heat-sealable base sheet is formed with slits said heat-sealable base sheet being molten and solidified along peripheral edges of said slits.

2. The process according to claim 1, comprising the steps of:

bonding said fibers to upper and lower surfaces of said heat-sealable base to form the assembly of said fibers and said heat-sealable base sheet; and pressing said cutter against the assembly of said fibers and said heat-sealable base sheet so that a plurality of fibers lying on opposite surfaces of said heat-sealable base sheet are severed and said heat-sealable base sheet is molten and solidified along the peripheral edges of said slits.

3. The process according to claim 1, wherein the opposite surfaces of said heat-sealable base sheet are slit substantially simultaneously.

* * * * *